US010930181B2

(12) United States Patent
Bray et al.

(10) Patent No.: US 10,930,181 B2
(45) Date of Patent: Feb. 23, 2021

(54) DISPLAY SIGN AND METHOD OF DISPOSING SAME

(71) Applicant: R.R. Donnelley & Sons Company, Chicago, IL (US)

(72) Inventors: Victoria Bray, Carrollton, TX (US); Howard Peck, Carrollton, TX (US); Jeffrey L. Braun, West Chester, OH (US)

(73) Assignee: R. R. Donnelley & Sons Company, Chicago, IL (US)

( * ) Notice: Subject to any disclaimer, the term of this patent is extended or adjusted under 35 U.S.C. 154(b) by 0 days.

(21) Appl. No.: 16/196,293

(22) Filed: Nov. 20, 2018

(65) Prior Publication Data

US 2019/0156711 A1 May 23, 2019

Related U.S. Application Data

(60) Provisional application No. 62/589,752, filed on Nov. 22, 2017.

(51) Int. Cl.

| | |
|---|---|
| ***G09F 15/00*** | (2006.01) |
| ***G09F 13/20*** | (2006.01) |
| *G09F 7/18* | (2006.01) |

(52) U.S. Cl.

CPC ..... *G09F 15/0037* (2013.01); *G09F 13/20* (2013.01); *G09F 15/0025* (2013.01); *G09F 15/0062* (2013.01); *G09F 2007/1834* (2013.01); *G09F 2015/0093* (2013.01)

(58) Field of Classification Search

CPC ..... G09F 15/0037; G09F 15/0062; G09F 15/0025; G09F 13/20; G09F 2015/0093

See application file for complete search history.

(56) References Cited

U.S. PATENT DOCUMENTS

| | | | | | |
|---|---|---|---|---|---|
| 381,879 | A * | 4/1888 | Ford | B65D 63/10 | 24/17 R |
| 2,127,930 | A * | 8/1938 | Osborn | G09F 1/00 | 40/603 |
| 2,516,292 | A * | 7/1950 | Bennett | B65D 63/10 | 206/497 |
| 3,214,852 | A * | 11/1965 | Ford | G09F 3/005 | 40/586 |
| 5,557,817 | A * | 9/1996 | Haddock | A61G 7/0507 | 5/425 |
| 5,860,237 | A * | 1/1999 | Johnson | G09F 15/00 | 40/603 |
| 5,890,227 | A * | 4/1999 | Brown | A41D 13/0007 | 2/102 |
| 7,198,835 | B2 * | 4/2007 | Anderson | A47H 23/04 | 428/100 |
| 2002/0145805 | A1 * | 10/2002 | Hall | A41D 13/01 | 359/516 |

(Continued)

*Primary Examiner* — Cassandra Davis

(74) *Attorney, Agent, or Firm* — McCracken & Gillen LLC

(57) ABSTRACT

A display sign and a method of disposing the display sign are disclosed in which the display sign includes a first panel made of a first flexible substrate having a first side portion, a second panel made of a second flexible substrate having second side portion, and a strap having an elastic portion. A first end of the strap is secured to the first panel, a second end of the strap is secured to the second panel, and the strap couples the first side portion and the second side portion.

16 Claims, 7 Drawing Sheets

(56) References Cited

U.S. PATENT DOCUMENTS

| | | | | |
|---|---|---|---|---|
| 2013/0097784 | A1* | 4/2013 | Kaplan | A47D 15/00 5/663 |
| 2015/0116988 | A1* | 4/2015 | Uriarte | G08B 5/004 362/108 |

* cited by examiner

DISPLAY SIGN AND METHOD OF DISPOSING SAME

CROSS-REFERENCE TO RELATED APPLICATIONS

The present application claims benefit of Bray et al., U.S. Provisional Patent Application No. 62/589,752, filed Nov. 22, 2017, and entitled "Display Sign". The entire contents of this application are hereby incorporated by reference.

FIELD OF DISCLOSURE

The present subject matter relates to display signs, and more particularly, to display signs that may be disposed between posts.

BACKGROUND

Barriers that include a single post or adjacent posts, such as bollards, barricades, inverted-u barriers, and the like, are used to demarcate areas and to prevent entry into particular areas by, for example, vehicular traffic. For example, such barriers may be used in front of a building, or to surround parkland or a gas station pump to prevent entry into such areas by a vehicle.

In addition to providing protection from entry, a display sign may be secured to such barriers to display an advertisement or informational message. However, because the barriers are typically outdoors, the display sign should be durable in different weather conditions. Further, because posts that comprise the barriers may be of different sizes and the distances between such barriers may vary, the display sign should be adaptable to be secured to barriers having posts of various sizes and spacing therebetween.

The aspects and advantages of the subject matter of present disclosure will become apparent upon consideration of the following detailed description and the attached drawings wherein like numerals designate like structures throughout the specification.

SUMMARY

According to one aspect, a display sign includes a flexible first panel having a first side portion, a flexible second panel having a second side portion, and a strap having an elastic portion. A first end of the strap is secured to the first panel, a second end of the strap is secured to the second panel, and the strap couples the first side portion and the second side portion.

According to another aspect, a method of disposing a display sign between two posts, wherein the display sign comprises a flexible first panel, a flexible second panel, and a strap movable between a stretched position and an unstretched position that couples the first and second panels, includes the step of disposing the display sign relative to the two posts such that the first panel, the second panel, and the elastic strap together surround the two posts, wherein the first and the second panels are substantially taut, and the strap is in a stretched position.

DETAILED DESCRIPTION

Figure 1:
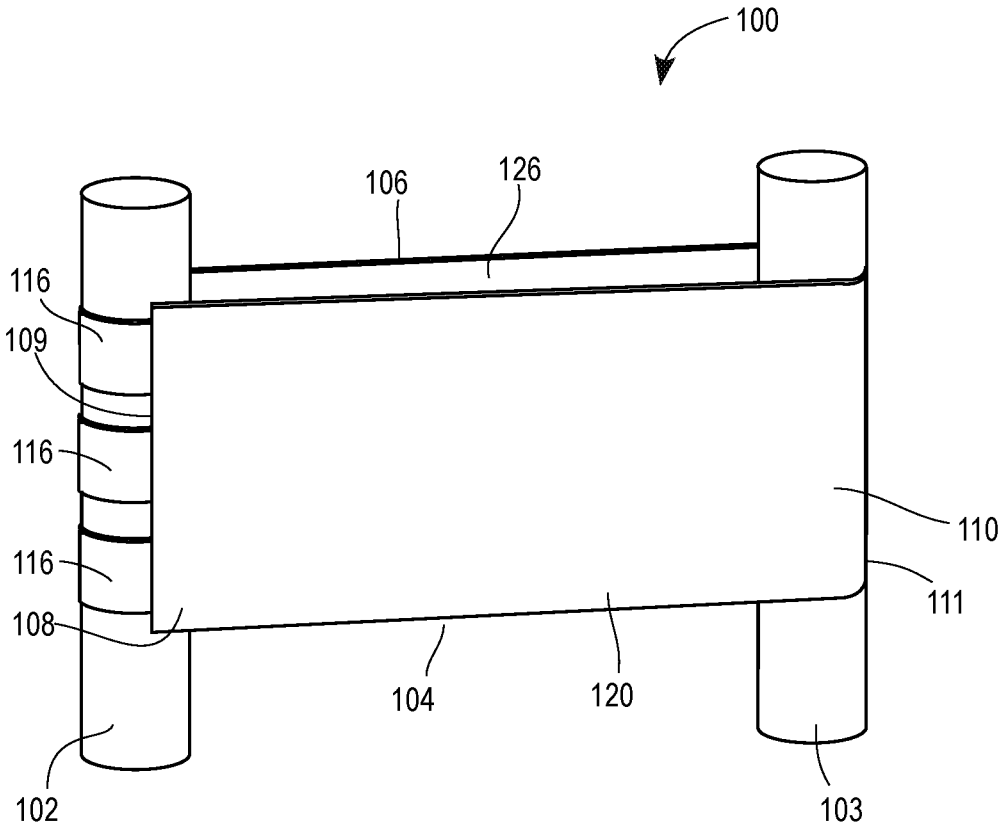
FIG. 1 is an isometric view of a display sign disposed between two posts.
Figure 2:
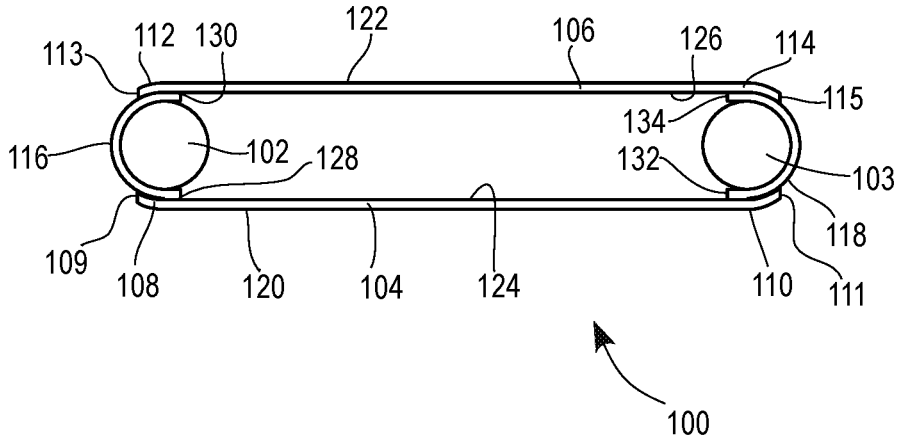
FIG. 2 is a plan view of the display sign of FIG. 1.
Figure 3:
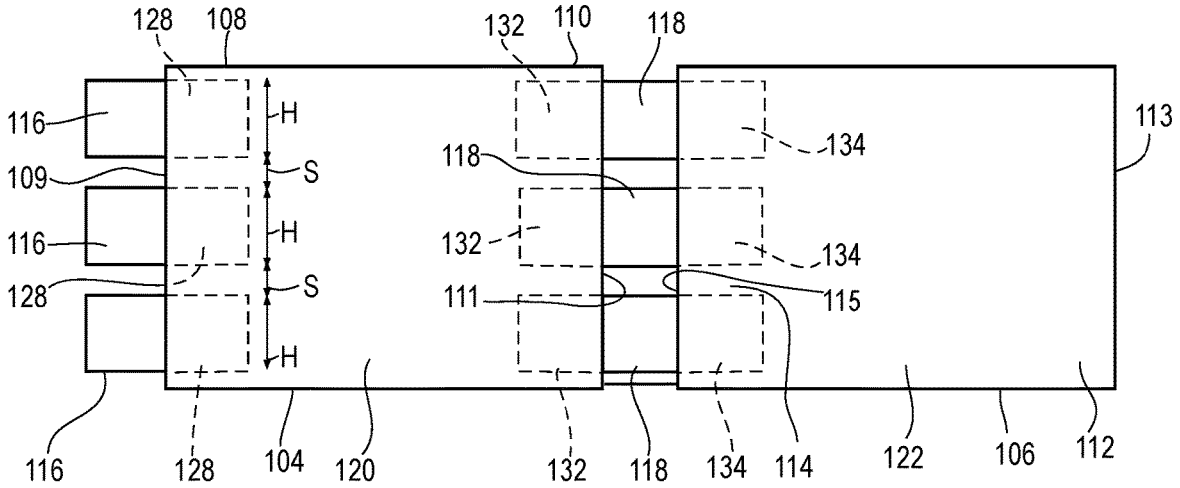
FIG. 3 is an elevational view of one side of the display sign of FIG. 1, wherein the display is disposed in a flat condition.
Figure 4:
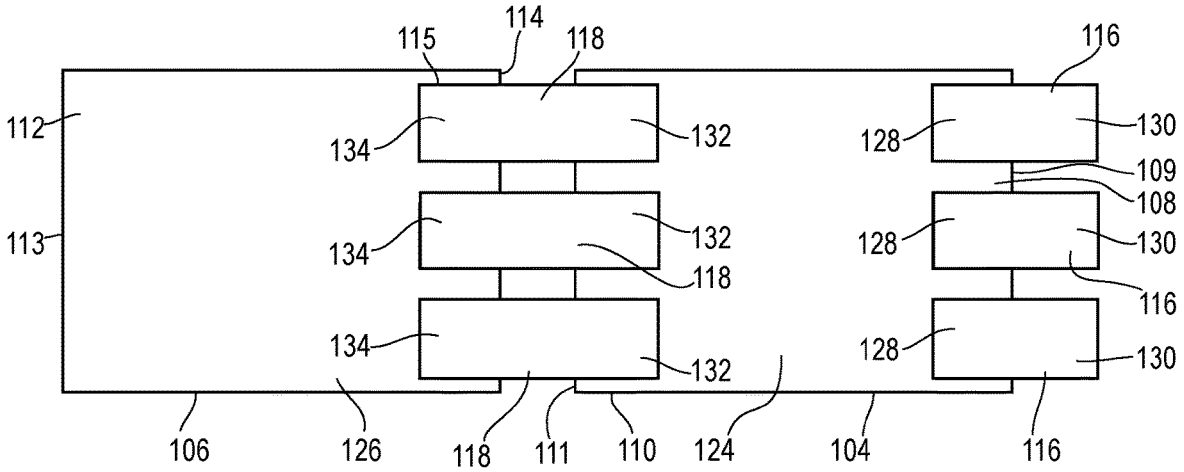
FIG. 4 is an elevational view of another side of the display sign of FIG. 3.

Referring to FIGS. 1-4, a display sign 100 is disposed on a first post 102 and a second post 103. The display sign 100 includes a first panel 104 and a second panel 106. The first panel 104 includes a first side portion 108 proximate a first side edge 109 and a second side portion 110 proximate a second side edge 111. The second panel 106 includes a third side portion 112 proximate a third side edge 113 and a fourth side portion 114 proximate a fourth side edge 115. One or more straps 116 couple(s) the first side portion 108 of the first panel 104 with the third side portion 112 of the second panel 106, and one or more straps 118 couple(s) the second side portion 110 of the first panel 104 with the fourth side portion 114 of the second panel 106. As shown in FIGS. 1 and 2, the first panel 104, the second panel 106, the first strap 116 and the second strap 118 combine to surround the first post 102 and the second post 103.

In some embodiments, the first panel 104 and the second panel 106 have substantially identical dimensions. In other embodiments, the first panel 104 and the second panel 106 have different dimensions. The first panel 104 and the second panel 106 include outer surfaces 120 and 122, respectively, and inner surfaces 124 and 126, respectively. Any of the surfaces 120-126 and/or the straps 116, 118 may be imprinted with indicia using any printing methods including inkjet, electrophotography, lithography, flexography, gravure, and the like.

The first panel 104, the second panel 106, the first strap(s) 116, and the second strap(s) 118 may be manufactured using a material including vinyl, plastic, coated or uncoated paper, coated or uncoated fabric, polyester, nylon, and the like. In an exemplary embodiment, the first panel 104 and the second panel 106 are flexible, and optionally elastic, the strap(s) 116 and 118 are flexible, and one or both of the first strap(s) 116 and the second strap(s) 118 is (are) elastic. The flexibility of these components 104, 106, 116, and 118 allows the display sign 100 to be rolled and/or folded for ease of storage and transport. Further, having one or both of the first strap(s) 116 and the second strap(s) 118 elastic allows the assembled display sign 100 to be accommodated on posts of various sizes and separated by various distances, and to be easily installed on such posts.

In some embodiments, a first terminal portion 128 of the first strap 116 is secured to the first side portion 108 of the first panel 104 and a second terminal portion 130 of the first strap 116 is secured to the third side portion 112 of the second panel 106. Similarly, a third terminal portion 132 of the second strap 118 is secured to the second side portion 110 of the first panel 104 and a fourth terminal portion 134 of the second strap 118 is secured to the fourth side portion 114 of the second panel 106.

The first, second, third, and fourth terminal portions 128, 130, 132 and 134 may be secured to the first side portion 108, the second side portion 110, the third side portion 112, and the fourth side portion 114, respectively, by any appropriate fastening method including sewing, hook and loop fasteners, buttons or snaps, adhesively adhering, riveting, and the like, and any combination thereof. In some embodiments, the first, second, third, and fourth terminal portions 128-134 are elastic like the rest of the straps 116, 118. In other embodiments, such terminals portions 128-134 are not elastic and the remainder of the strap is elastic. Referring to FIG. 2, in some embodiments, a fastener may be selected that allows the length of the portion of the strap 116 between the edges 109 and 113 to be adjustable. Similarly, a fastener may be selected that allows the length of the portion of the strap 118 between the edges 111 and 115 to be adjustable. Any such fastener apparent to one who has skill in the art including hook and loop, a plurality of buttons or snaps, and the like may be used to enable adjustment of distances of the portion of the strap 116 or 118 between the edges 109 and 113 and/or the edges 111 and 114, respectively. Such adjustability allows the display 100 to be usable with posts 102 and/or 103 of varying diameters and/or distances therebetween.

Figure 5:
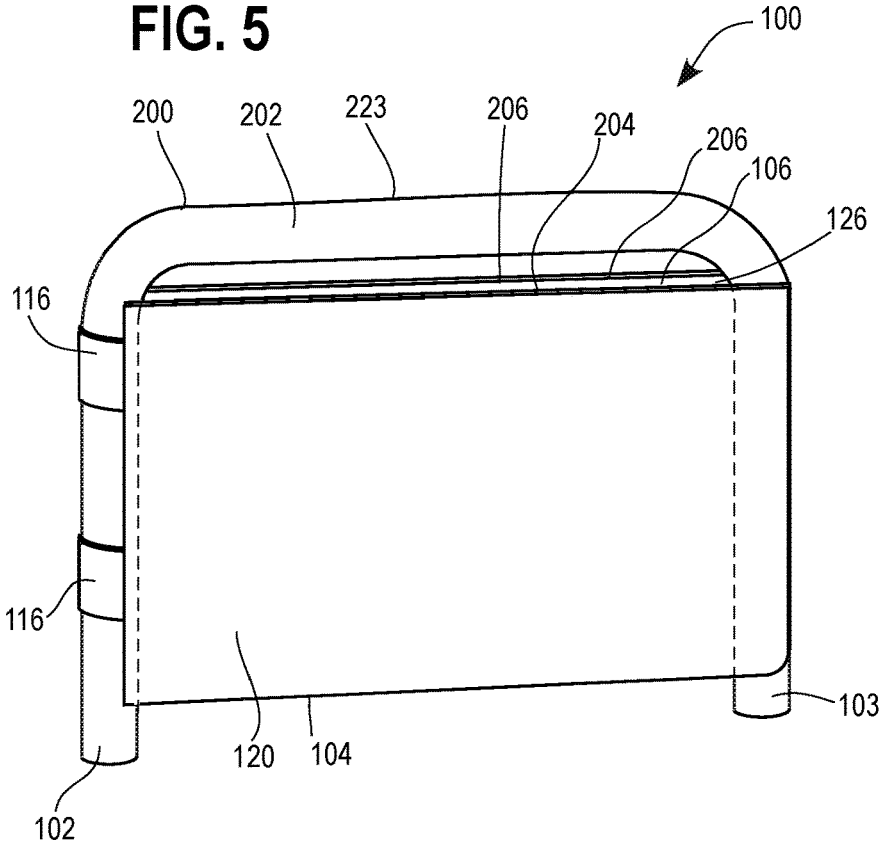
FIG. 5 is an isometric view of another embodiment of the display sign of FIG. 1 disposed between two posts joined by a crossbar.

Referring to FIG. 5, the display sign 100 is disposed between posts 102 and 103 of a barrier 200 that includes a cross-member 202 that connects the two posts 102 and 103. Such a barrier may be, for example, an inverted "U" barrier, an inverted semi-circle barrier, a loop style bicycle rack, and the like. In some cases, and as shown in FIG. 5, when the display sign 100 is disposed on such a barrier 200, a portion of the cross-member 202 may be visible beyond a top edge 204 of the first panel 104 and/or a top edge 206 of the second panel 106 and may detract from the appearance of the display sign 100.

Figure 6:
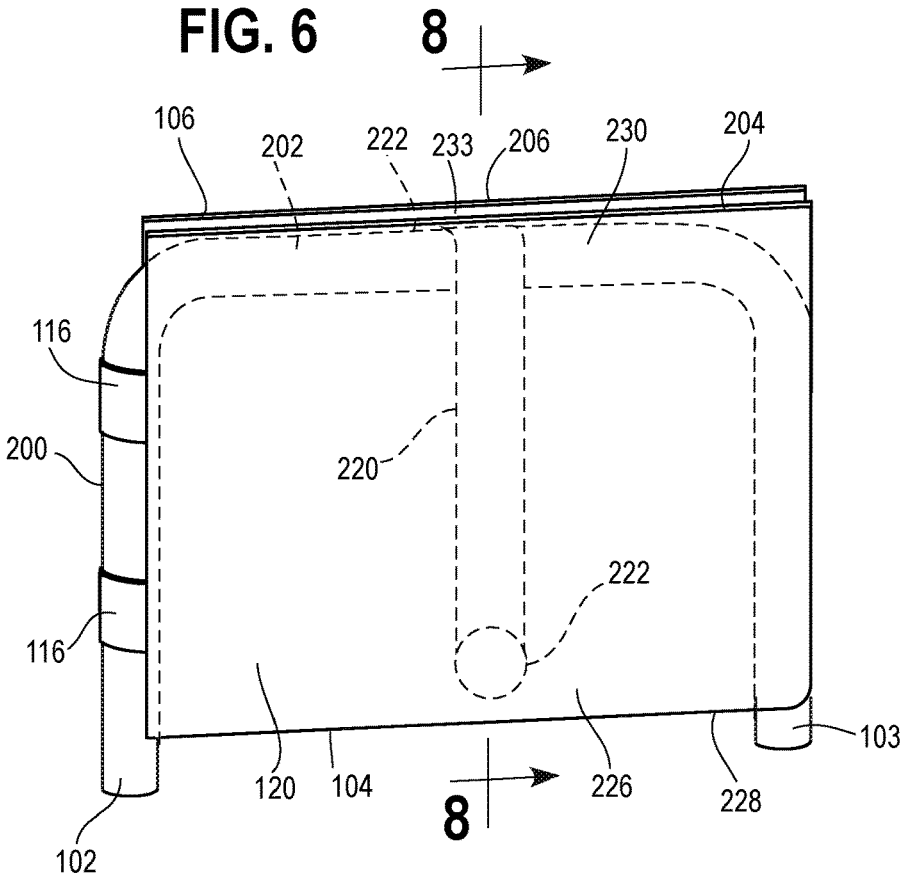
FIG. 6 is an isometric view of yet another embodiment of a display sign disposed between two posts joined by a crossbar.
Figure 7:
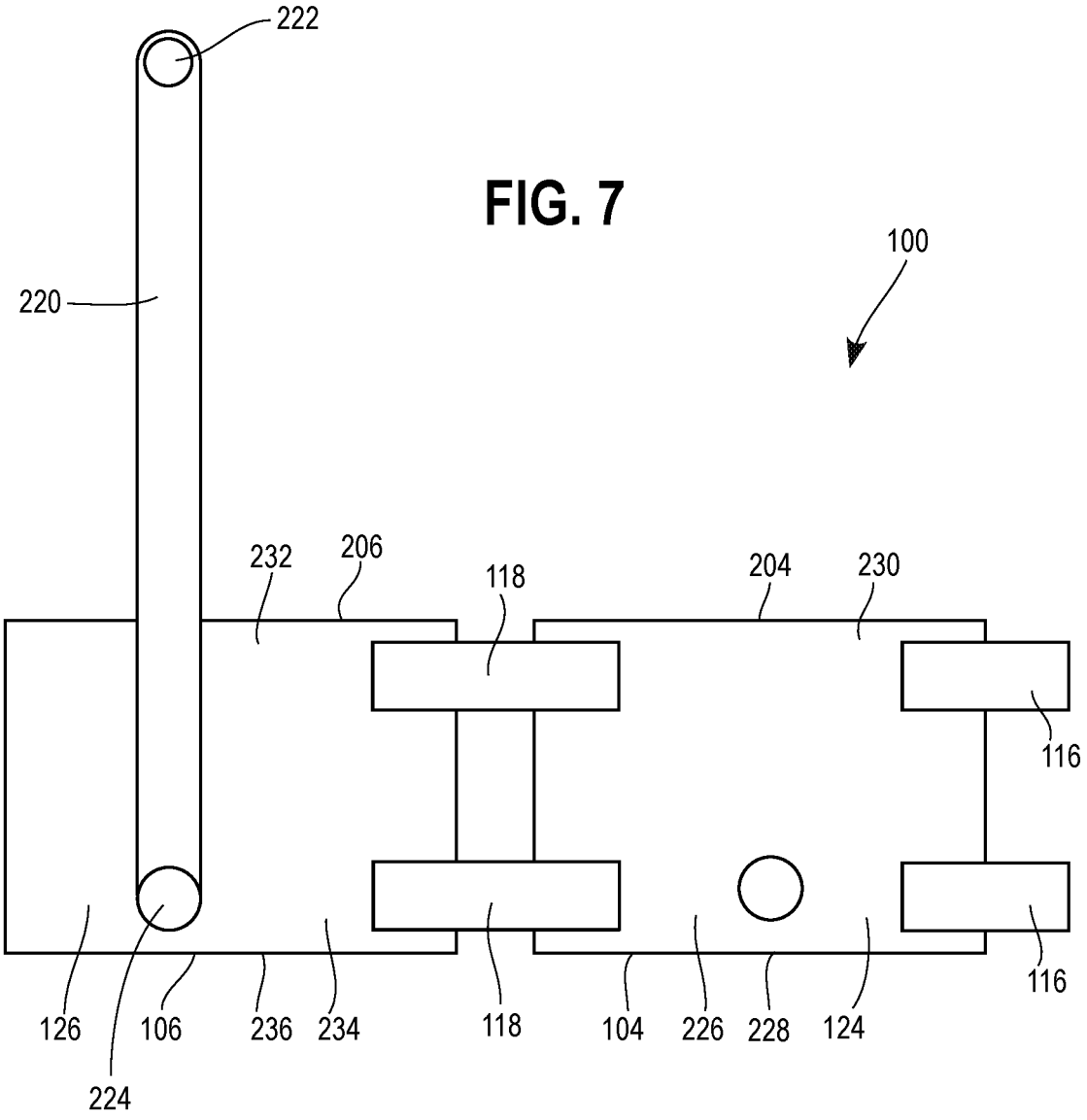
FIG. 7 is an elevational view of a side of the display sign of FIG. 6, wherein the display is disposed in a flat condition.
Figure 8:
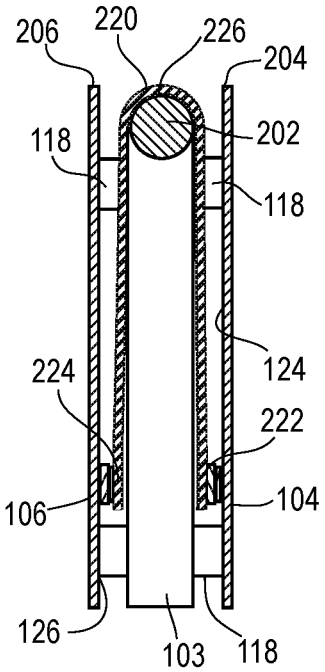
FIG. 8 is a cross-sectional view of the display sign, crossbar, and post of FIG. 6 taken generally along the lines 8-8 of FIG. 6.

Referring to FIGS. 6-8, the display sign 100 may include a strap 220 having a first end 222 secured to the interior surface 124 of the panel 104 and a second end 224 secured to the interior surface 126 of the panel 106 and forming a loop therebetween.

In some embodiments, the first end 222 and the second end 224 of the strap 220 are permanently secured to the interior surfaces 124 and 126, respectively. In other embodiments, the first end 222 and the second end 224 of the strap 220 are both removably secured to the interior surfaces 124 and 126, respectively. In still other embodiments, one of the first end 222 and the second end 224 of the strap 220 is removably secured to one of the interior surfaces 124 and 126, and the other of the first end 222 and the second end 224 of the strap is permanently secured to the other of the interior surfaces 124 and 126. The strap 220 may be made of a flexible elastic material identical to that used to manufacture the straps 116 and 118, a flexible material identical to that used to manufacture the panels 104 and 106, or any other flexible material apparent to one who has skill in the art.

In some embodiments, one or both of the first end 222 and/or the second end 224 of the strap 220 may be fixedly or removably secured to the interior surfaces 124 and/or 126, respectively, by sewing, adhesively adhering, or using a fastener. Such fastener may include a button and corresponding buttonhole, a snap button, a hook and loop fastener, and the like.

When the display sign 100 is disposed between the posts 102 and 103, the strap 220 is positioned such that the strap 220 extends upwardly away from a bottom portion 226 proximate a bottom edge 228 of the first panel 104 toward a top portion 230 proximate the top edge 204, passes over a top portion 223 of the cross member 202, and then extends downwardly away from a top portion 232 proximate the top edge 206 toward a bottom portion 234 proximate a bottom edge 236 of the second panel 106. Disposing the strap 220 in this manner prevents the panels 104 and 106 from being lowered sufficiently to expose the cross member 202. It should be apparent that the first end 222 of the strap 220 may be secured anywhere on the inner surface 124 between the bottom edge 228 and the top edge 204 of the panel 104 and the second end 224 of the strap 220 may be secured anywhere on the inner surface 126 between the bottom edge 236 and the top edge 206 of the second panel 106.

Figure 9:
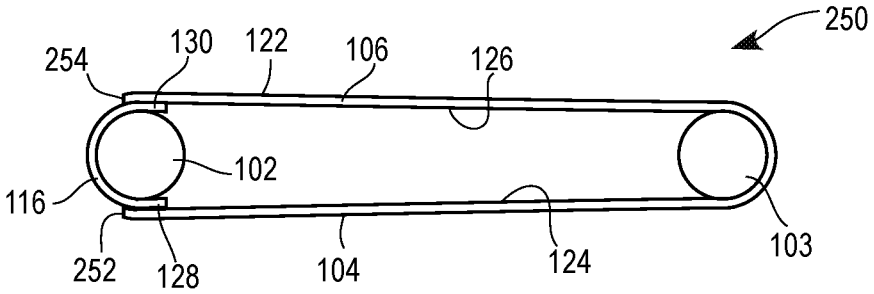
FIG. 9 is a plan view of still another display sign disposed between two posts.
Figure 10:
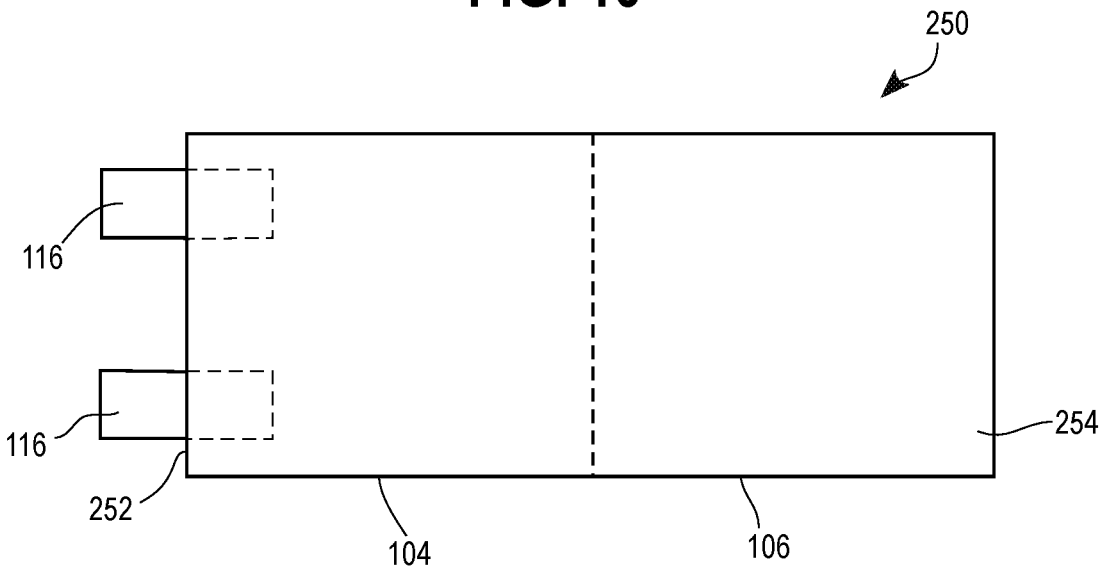
FIG. 10 is an elevational view of a side of the display sign of FIG. 9, wherein the display is disposed in a flat condition.

Referring to FIGS. 9 and 10, an embodiment of the display sign 250 is substantially identical to the display sign 100 except the display sign 250 does not include straps 118. Instead, the first and second panels 104 and 106 form one integral sheet. One or more elastic straps 116 couple a first end 252 of the display sign 250 with a second end 254 of the display sign 250.

One or more of the straps 116 and 118 may include reflective elements to allow such straps to be visible in low light situations. In some embodiments, the strap 116 or 118 may be made from a fluorescent or light reflective material, or may include threads woven therethrough made of fluorescent or light reflective material.

Figure 11:
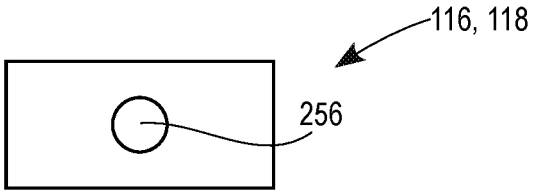
FIG. 11 is a side elevational view of a strap of the display signs of any of the foregoing FIGS.

Referring to FIG. 11, one or more of the straps 116 and 118 may include one or more component(s) 256 that is (are) a reflector or a light emitter.

Figure 12:
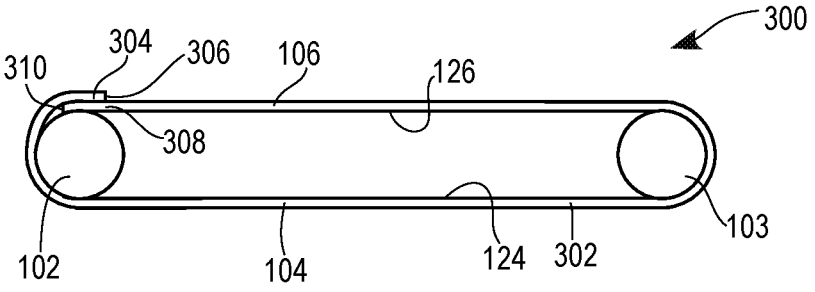
FIG. 12 is a plan view of yet another display sign disposed between two posts.

Referring to FIG. 12, in one embodiment, the display sign 300 is substantially identical to the display signs 100 and 250 described above, except the display sign 300 does not include the straps 116 or 118. In particular, the panels 104 and 106 comprise an integral sheet 302 that is surrounds the two posts 102 and 103 such that a first portion 304 proximate a first edge 306 of the sheet 302 overlaps a second portion 308 proximate a second edge 308 of the sheet 302. The first portion 304 and the second portion 306 are fastened to one another to hold the display sign 300 in place. The sheet 302 may be made of a flexible elastic material to allow the display sign to be dispose around posts 102 and 103 having varying diameters and distance therebetween. It should be apparent that any of ways of permanent or impermanent fastening methods described in the embodiments disclosed above may be used to fasten the first portion 304 and the second portion 306. Although in FIG. 12, the regions 304 and 306 are shown to overlap one another proximate the post 102, it should be apparent that such regions may overlap one another proximate the post 103, or anywhere between the posts 102 and 103.

Referring once again to FIGS. 1-4, in some embodiments, the straps 116 are spaced apart along the first side portion 108 of the panel 104. The height H along the edge 109 of each strap 116 is selected such that a height of a space S along the edge 109 between adjacent pairs of straps 116 is less than the height H of each strap 116 that comprises such pair. It should be apparent that, even in this embodiment, heights H of the individual straps 116 and the heights of the spaces S therebetween may vary. The widths and the spacing between the adjacent pairs of straps 118 are also selected in this manner. Having relatively wide straps 116, 118 holds the panels 104 and 106 taut when the display sign 100 is disposed between the posts 102 and 103, and prevents buckling and/or rippling of the flexible materials used for such panels 104 and 106 that might occur if narrow straps were used.

In one embodiment, a display sign 100 includes panels 104 and 106 that are each approximately 35 inches wide (between posts) and approximately 25 inches tall (from top to bottom). Such display sign 100 includes straps 116 and 118 that are each approximately 6 inches wide. When not stretched, each strap 116 and 118 is approximately 6.5 inches long and can be stretched to be approximately 11 inches long. Such elasticity allows the display sign 100 to be disposed on posts having different radii and spacing therebetween. Also, the FIGS. in the foregoing show the display 100 disposed between two posts, it should be apparent that the display sign 100 may span any number of adjacent posts. Further, the display sign 100 may have more than two panels connected by straps and may be disposed on three or more posts that are not collinear.

INDUSTRIAL APPLICABILITY

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar references in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the disclosure and does not pose a limitation on the scope of the disclosure unless otherwise claimed. No language in the specification should be construed as indicating any non-claimed element as essential to the practice of the disclosure.

Numerous modifications to the present disclosure will be apparent to those skilled in the art in view of the foregoing description. It should be understood that the illustrated embodiments are exemplary only, and should not be taken as limiting the scope of the disclosure.

We claim:

1. A display sign disposed between two posts, comprising:

a flexible first panel having a first side portion and a second side portion;

a flexible second panel having a third side portion and a fourth side portion;

a first strap moveable between a stretched position and an unstretched position, wherein the first strap couples the first and the third side portions; and a second strap spaced apart from the first strap, wherein the second strap couples the first and third side portions;

a third strap moveable between a stretched position and an unstretched position, wherein the third strap couples the second and fourth side portions; and a fourth strap spaced apart from the third strap, wherein the fourth strap couples the second and fourth side portions;

wherein the first strap and second strap extend beyond an edge proximate the first side portion, a height of the first strap along the edge is greater than a distance along the edge between the first and second straps, the third strap and fourth strap extend beyond an edge proximate the second side portion, and the display sign is disposed between the two posts such that the first panel, the second panel, and the first through the fourth straps together surround the two posts, the first and second panels are substantially taut, and the first strap is in a stretched position.

2. The display sign of claim 1, wherein the first and second posts are upright.

3. The display sign of claim 1, wherein the first strap is permanently secured to the first panel, the second panel, or both.

4. The display sign of claim 1, wherein the first panel and second panel form an integral sheet.

5. The display sign of claim 1, wherein the first strap includes a fluorescent or reflective material.

6. The display sign of claim 5, wherein the fluorescent or reflective material comprises a thread woven through the first strap.

7. The display sign of claim 1, wherein the first strap includes a light emitter.

8. A display sign, comprising:

a flexible first panel having a first side portion;

a flexible second panel having a second side portion;

a first strap having an elastic portion, wherein a first end of the first strap is secured to the first panel, a second end of the first strap is secured to the second panel, and the first strap couples the first side portion and the second side portion, and a second strap that couples the first panel and the second panel, wherein the first panel includes a first bottom portion and a first top portion, the second panel includes a second bottom portion and a second top portion, the second strap is secured to the first panel and the second panel, and the second strap extends upwardly away from the first bottom portion toward the first top portion and downwardly from the second top portion toward the second bottom portion.

9. The display sign of claim 8, wherein the second strap is removably secured to one or both of the first panel and the second panel.

10. The display sign of claim 8, wherein the first panel includes a first interior surface and the second panel includes a second interior surface that faces the first interior surface, and the second strap couples the first interior surface and the second interior surface.

11. A method of disposing a display sign between two posts, wherein the display sign comprises a flexible first panel having a first side portion, a flexible second panel, a first strap movable between a stretched position and an unstretched position that couples the first and second panels, and a second strap that couples first and second side panels, comprising the steps of:

disposing the display sign relative to the two posts such that the first panel, the second panel, and the first strap together surround the two posts the first and the second panels are substantially taut, and the first strap is in a stretched position; and disposing the first strap and the second strap such that the first strap and second strap extend beyond an edge proximate the first side portion and a height of the first strap along an edge proximate the first side portion is greater than a height of a space along the edge between the first and second straps.

12. The method of claim 11, the first panel includes a second side portion and the second panel includes a third side portion, further including the step of coupling the third side portion and the fourth side portion with the third strap.

13. A method of disposing a display sign between two posts, wherein the display sign comprises a flexible first panel that includes a first top portion and a first bottom portion, a flexible second panel that includes a second top portion and a second bottom portion, a first strap movable between a stretched position and an unstretched position that couples the first and second panels, and a second strap, comprising the steps of:

disposing the display sign relative to the two posts such that the first panel, the second panel, and the first strap together surround the two posts, the first and the second panels are substantially taut, and the first strap is in a stretched position; and extending the second strap upwardly away from the first bottom portion toward the first top portion and downwardly from the second top portion toward the second bottom portion, and securing the second strap to the first panel and the second panel.

14. The method of claim 13, wherein securing the second strap includes the step of permanently securing the second first strap to a first interior surface of the first panel, a second interior surface of the second panel, or both.

15. A method of disposing a display sign between two posts, wherein the display sign comprises a flexible first panel, a flexible second panel, and a strap movable between a stretched position and an unstretched position that couples the first and second panels, comprising the steps of:

disposing the display sign relative to the two posts such that the first panel, the second panel, and the strap together surround the two posts, the first and the second panels are substantially taut, the strap is in a stretched position, and the strap includes a fluorescent or reflective material.

16. The method of claim 15, wherein the fluorescent or reflective material comprises a thread woven through the strap.

* * * * *